United States Patent [19]

Bessho

[11] 4,391,243

[45] Jul. 5, 1983

[54] METHOD AND APPARATUS OF SUPPLYING FUEL IN ELECTRONIC CONTROL FUEL INJECTION ENGINE

[75] Inventor: Hironori Bessho, Susono, Japan

[73] Assignee: Toyota Jidosha Kogyo Kabushiki Kaisha, Toyota, Japan

[21] Appl. No.: 348,179

[22] Filed: Feb. 12, 1982

[30] Foreign Application Priority Data

Sep. 11, 1981 [JP] Japan ..... 56-142535

[51] Int. Cl.[3] ..... F02D 5/02

[52] U.S. Cl. ..... 123/325; 123/493

[58] Field of Search ..... 123/325, 326, 320, 493, 123/492

[56] References Cited

U.S. PATENT DOCUMENTS 4,276,863 7/1981 Sugasawa et al. ..... 123/493 X 4,311,123 1/1982 Glöckler et al. ..... 123/493 X 4,337,512 6/1982 Furuhashi ..... 123/493 X

*Primary Examiner*—William A. Cuchlinski, Jr.

*Attorney, Agent, or Firm*—Cushman, Darby & Cushman

[57] ABSTRACT

Fuel is cut off in the deceleration of a vehicle to improve efficiency of fuel consumption. Rotational speed of an engine in the resumption of fuel supply in the completion of the fuel cut-off is set to a value smaller than that otherwise set when a brake device is operated or the vehicle speed is higher than a predetermined value. While the torque of the engine varies abruptly to produce impact when the fuel cut-off is completed, passengers have a slight feeling of impact while the vehicle is being braked and travelling with high speed. Thus, while the feeling of impact is reduced, a period of fuel cut-off is increased to improve further the efficiency of fuel consumption and others.

6 Claims, 7 Drawing Figures

METHOD AND APPARATUS OF SUPPLYING FUEL IN ELECTRONIC CONTROL FUEL INJECTION ENGINE

BACKGROUND OF THE INVENTION

1. Field of the Invention

This invention relates to a method and apparatus of supplying fuel in an electronic control fuel injection engine for controlling the supply of fuel from a fuel injection valve to an intake system by operating the fuel injection valve according to electric signals and more particularly to a method and apparatus of supplying fuel for controlling the rotational frequency of an engine when fuel cut-off is completed and then fuel supply is resumed.

2. Description of the Prior Arts

In an electronic control fuel injection engine, it is well known to cut off fuel in the deceleration of a vehicle for improving efficiency of fuel consumption and restraining amount of purge of noxious components. When rotational speed of the engine is lowered to a predetermined value or less, fuel needs to be cut off completely and then supplied again for avoiding the stoppage of the engine rotation (engine stop). However, when the fuel supply is resumed, the output torque of the engine is abruptly increased, unbalance between the output torque of the engine and torque of driving wheels gives impact to the vehicle. In prior method and apparatus of supplying fuel to electronic control fuel injection engines, the rotational speed of the engine at the resumption of fuel supply could not be set to a small value to avoid the impact to the vehicle at the resumption of fuel supply after the completion of fuel cut-off so that the improvement of efficiency of fuel consumption during the deceleration and the restraint of purge of noxious components could not be sufficiently achieved. Also, a fuel supplying method has been proposed in which the rotational speed of the engine at the resumption of fuel supply is changed over from a large value to small one to increase a period of fuel cut-off when the transmission at the deceleration is changed over from the high speed stage to the low speed one. However, in this method, the impact at the resumption of fuel supply can not sufficiently restrained.

SUMMARY OF THE INVENTION

An object of the present invention is to provide a method and apparatus of supplying fuel to an electronic control fuel injection engine, which can avoid impact at the resumption of fuel supply while increasing a period of fuel cut-off at the deceleration to thereby improve efficiency of fuel consumption and reduce the purge of noxious components.

To achieve this object, in the method of supplying fuel to the electronic control fuel injection engine according to the present invention, when a brake device is operated or the vehicle speed is higher than a predetermined value, the rotational speed of the engine at the resumption of fuel supply after the completion of fuel cut-off in the deceleration is set to a value smaller than that set otherwise.

Also, the fuel supplying apparatus for the electronic control fuel injection engine according to the present invention comprises a first detecting means for detecting the operation of the brake device, a second detecting means for detecting vehicle speed, a comparator means for allowing a fuel injection valve to be operated when the rotational speed of the engine is compared with a reference value and found lower than the reference value and a control means for receiving detecting signals from the first and second detecting means and thereby, when the brake device is operated or the vehicle speed is higher than a predetermined value, reducing the reference value of the comparator means smaller than that set otherwise.

When the vehicle speed is large, difference between the output torque of the engine at the resumption of fuel supply after the competion of fuel cut-off and the torque of the driving wheel is small so that the impact at the resumption of fuel supply can be restrained. Thus, according to the present invention, the rotational speed of the engine at the resumption of fuel supply in the large vehicle speed is set to a small value so that the impact at the resumption of fuel supply can be restrained while the period of fuel cut-off can be increased.

Since negative acceleration applied to the vehicle during the operation of the brake device is large, a feeling of the impact on a driver and other passengers at the resumption of fuel supply is small. Thus, according to the present invention, the rotational speed of the engine at the resumption of fuel supply during the operation of the brake device is set to a small value so that the period of fuel cut-off can be increased without giving any uncomfortable feeling of impact to passengers.

Whether or not the brake device is operated can be detected by whether or not the brake pedal is operated. Whether or not the brake pedal is operated is detected at intervals of time and preferably the rotational speed of the engine at the resumption of fuel supply is set to a small value when the brake pedal is continuously operated. The driver may operate the brake pedal intermittently. In such a case, the fuel supply is resumed when the brake device is not operated so that the feeling of impact may be enlarged. By setting the rotational speed of the engine at the resumption of fuel supply to the small value only when the brake pedal is continuously operated, the resumption of fuel supply can be avoided when the driver releases the brake pedal.

In the fuel supply apparatus according to the present invention, the fuel is preferably cut off by blocking the generation of fuel injection pulse sent to the fuel injection valve. The first detecting means may be a switch for detecting the operational amount of the brake pedal.

Hereinafter will be described embodiments of the present invention with reference to the drawings.

DESCRIPTION OF THE PREFERRED EMBODIMENTS

Figure 1:
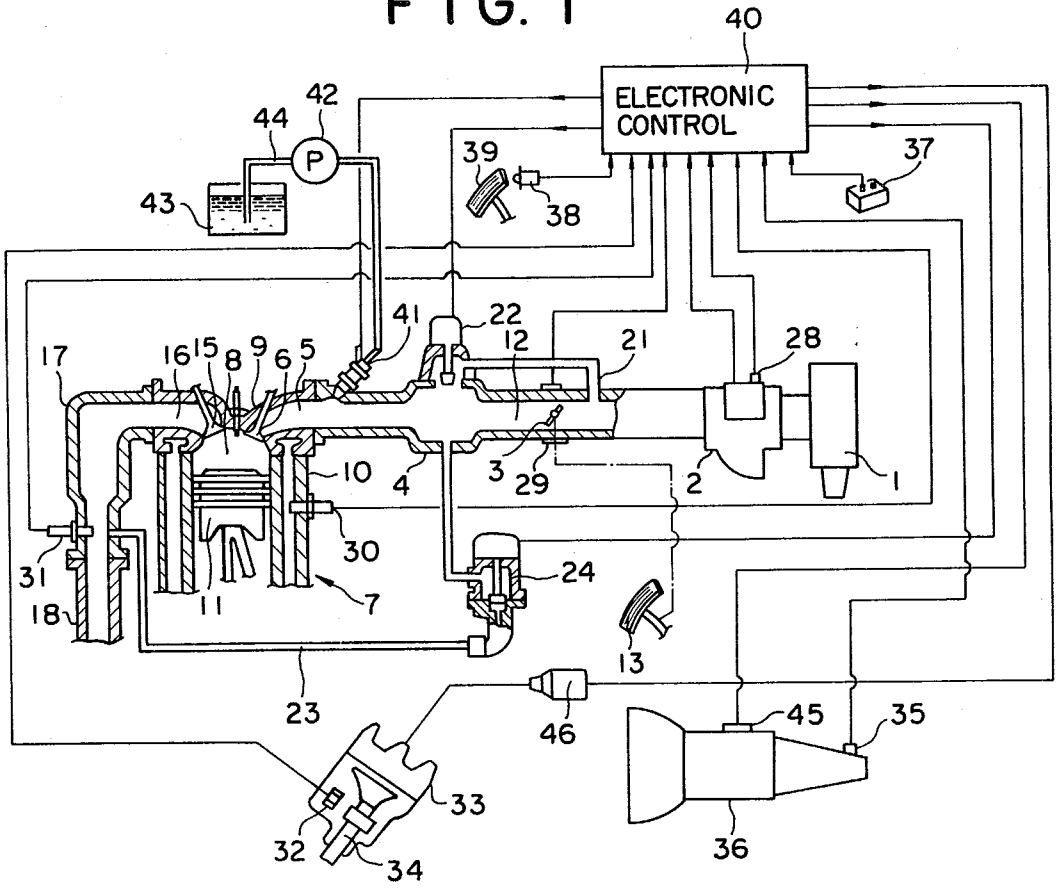
FIG. 1 is a schematic illustration of the whole electronic control fuel injection engine according to the present invention.

FIG. 1 is a schematic illustration of the whole electronic control fuel injection engine according to the present invention. Air sucked from an air cleaner 1 is sent to a combustion chamber 8 in a main body 7 of an engine through an intake path 12 comprising an air flow meter 2, throttle valve 3, surge tank 4, intake port 5 and intake valve 6. The throttle valve 3 is interlocked with an accelerator pedal 13 in a cab. The combustion chamber 8 is defined by a cylinder head 9, cylinder block 10 and piston 11, and exhaust gas produced by the combustion of mixture is purged to the atmosphere through an exhaust valve 15, exhaust port 16, exhaust branch pipe 17 and exhaust pipe 18. A bypass path 21 connects the upstream of the throttle valve 3 to the surge tank 4, and a bypass flow controlling valve 22 controls the sectional area of flow in the bypass path 21 to maintain the rotational speed of the engine constant in the idling. To restrain the generation of nitrogen oxide, an exhaust gas recirculation (EGR) path 23 for conducting the exhaust gas to the intake system connects the exhaust branch pipe 17 with the surging tank 4, and an exhaust gas recirculation (EGR) controlling valve 24 of on-off valve type opens and closes the EGR path 23 in response to electric pulses. An intake temperature sensor 28 is provided in the air flow meter 2 to detect the intake temperature, and a throttle position sensor 29 detects the opening of the throttle valve 3. A water temperature sensor 30 is mounted on the cylinder block 10 to detect cooling water temperature, i.e. engine temperature, an air fuel ratio sensor 31 well known for a oxygen concentration sensor is mounted on the aggregate portion of the exhaust branch pipes 17 to detect the oxygen concentration in the aggregate portion, and a crank angle sensor 32 detects the crank angle of crankshaft (not shown) in the engine body 7 through the rotation of a shaft 34 of a distributor 33 coupled with the crank-shaft. A vehicle speed sensor 35 detects the rotational speed of an output shaft of an automatic transmission or manual one 36, and a limit switch 38 detects the operation of a brake pedal 39. When the brake pedal 39 is depressed, the limit switch 39 is changed over from OFF to ON. The outputs of these elements 2,28,29, 30,31,32,35 and 38 and voltage of an accumulator 37 are sent to an electronic control 40. Fuel injection valves 41 are provided respectively near the respective intake ports 5 corresponding to the respective cylinders, and a pump 42 sends fuel to the fuel injection valves 41 from a fuel tank 43 through a fuel path 44. The electronic control 40 calculates the amount of fuel injection on the basis of input signals from the respective sensors to send electric pulses having pulse width corresponding to the calculated amount of fuel injection to the fuel injection valve 41. The electronic control 40 also controls the bypass flow controlling valve 22, EGR controlling valve 24, a solenoid 45 in a circuit for controlling the oil pressure in the automatic transmission or manual transmission 36 and an ignition system 46. The secondary side of a ignition coil in the ignition system 46 is connected to the distributor 33.

Figure 2:
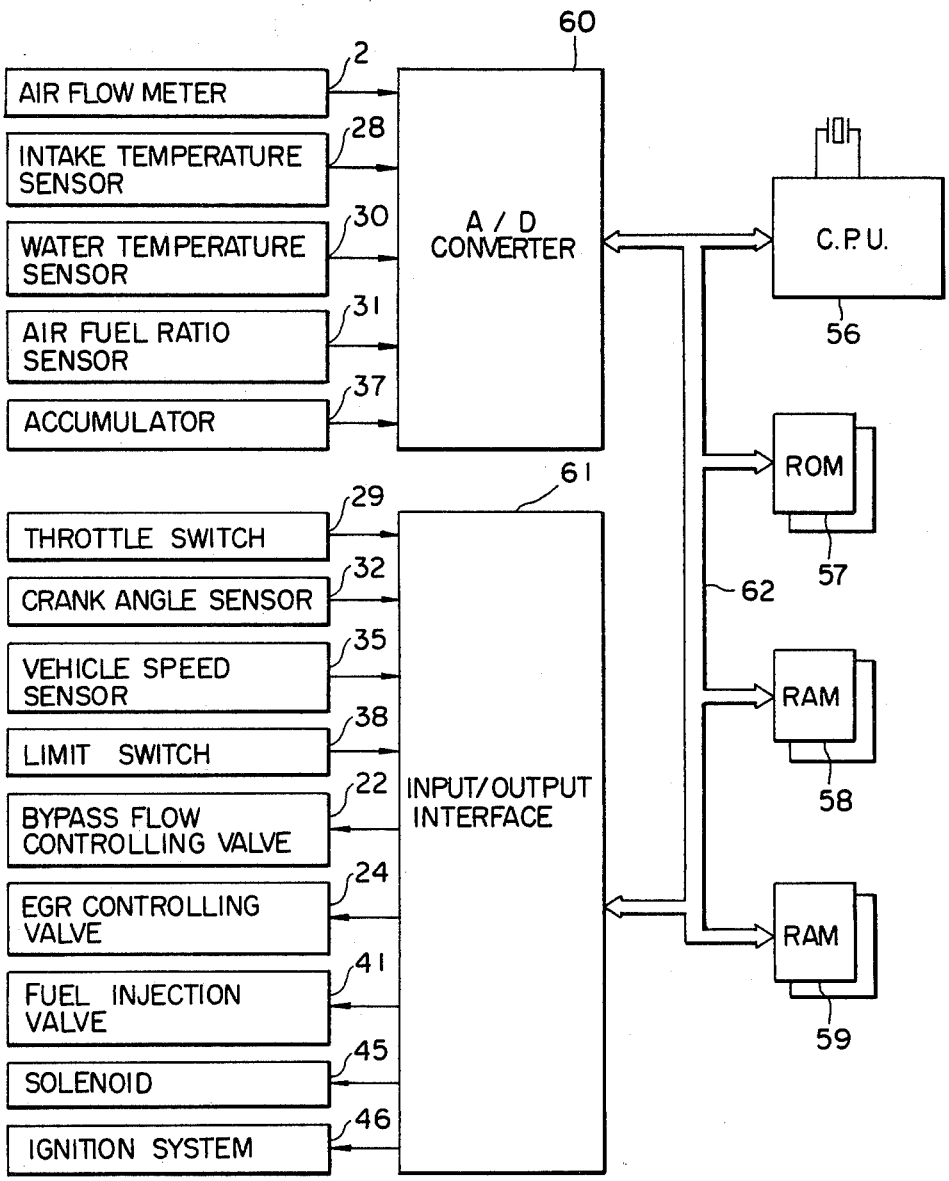
FIG. 2 is a block diagram of the electronic control shown in FIG. 1.

FIG. 2 is a block diagram of the interior of the electronic control. CPU(Central Processing Unit) 56, ROM(Read-Only Memory) 57, RAM(Randon Access Memory) 58, 59, A/D(Analog/digital) converter 60 with multiplexer and input/output interface 61 are connected to each other through a bus 62. RAM 59 is connected to an auxiliary power source so that it is supplied with a predetermined power to maintain the memory even when the ignition switch is opened and the engine is stopped. The analog signals of the air flow meter 2, intake temperature sensor 28, water temperature sensor 30 and air fuel ratio sensor 31 are sent to the A/D converter 60. The outputs of the throttle position sensor 29, crank angle sensor 32, vehicle speed sensor 35 and limit switch 38 are sent to the input/output interface 61, and the input signal of the input/output interface 61 is sent to the bypass flow controlling valve 22, EGR controlling valve 24, fuel injection valve 41, solenoid 45 and ignition system 46.

Figure 3:
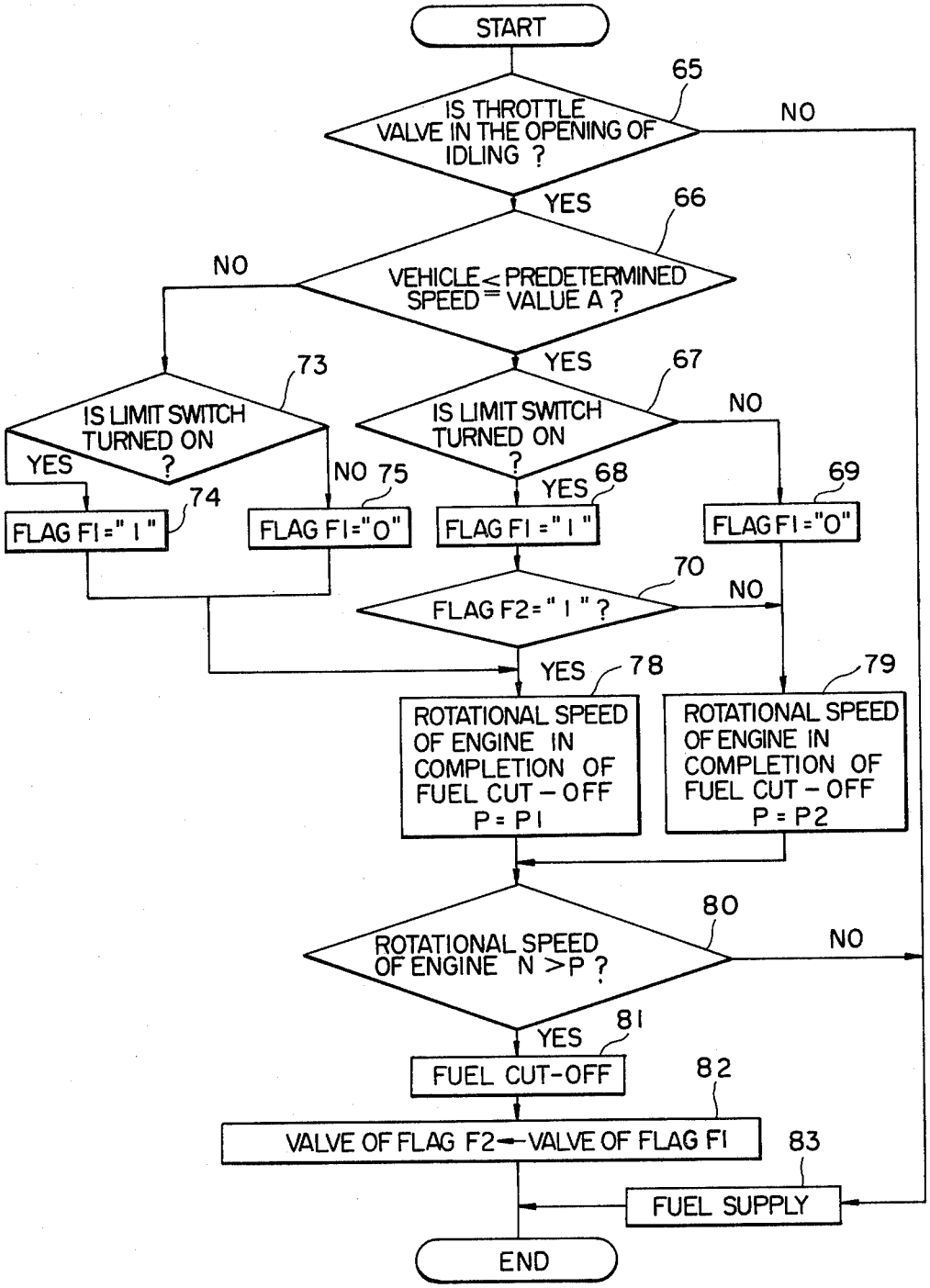
FIG. 3 is a flow chart of an example of a program carrying out the method according to the present invention.

FIG. 3 is a flow chart of an example of a program according to the present invention. In step 65 is judged according to the input signal from the throttle position sensor 29 whether or not the throttle valve 3 has the idling opening, and the program proceeds to step 66 if it is judged yes and to step 83 if no. In step 66 is judged according to the input signal from the vehicle speed sensor 35 whether or not the vehicle speed is lower than a predetermined value A, and the program proceeds to step 67 if it is judged yes and to step 73 if no. In step 67 is judged according to the input signal from the limit switch 38 whether or not the vehicle is being braked, and the program proceeds to step 68 if it is judged yes and to step 69 if no. In step 68, flag F1 is set to "1", provided binary logic is defined as "1", "0". The flag F1="1" means the vehicle is now being braked. In step 69, flag F1 is set to "0". The flag F1="0" means the vehicle is not now braked. In step 70 is judged whether or not flag F2 is "1" and the program proceeds to step 78 if it is judged yes and to step 79 if no. As will be understood from step 82 which will be described, the flag F2 is a flug for judging whether or not the limit switch 38 is turned on when this program was previously carried out. The flag F2="1" means that the limit switch 38 at the previous time was turned on and the vehicle was being braked. The reason why step 70 is provided is that the driver may depress or release the brake pedal 39 without operating continuously the brake pedal so that the fuel supply may be resumed when the vehicle is not braked and in this case the selection of small value of rotational speed set in the resumption of the fuel supply by the performance of step 78, which will be described, should be avoided. In step 73, similarly to step 67, is judged whether or not the limit switch 38 is turned on and the program proceeds to step 74 if it is judged yes and to step 75 if no. In step 74, flag F1 is set to "1" and, in step 75, flag F1 is set to "0". In step 78, the rotational speed P of the engine at which the fuel cut-off is completed is set to a predetermined value P1. In step 79, the rotational speed P of the engine at which the fuel cut-off is completed is set to P2 (provided P2>P1.) Namely, when the vehicle speed is larger than a predetermined value A or the brake switch is turned on, P is set to smaller value P1 and when the vehicle speed is smaller than the predetermined value A and the brake switch is turned off, P is set to larger value P2. In step 80 is judged whether or not the rotational speed N of the engine is larger than P and the program proceeds to step 81 if it is judged yes and to step 83 if no. In step 81, fuel is cut off. In step 82, value of flag F1 is substituted for flag F2. Value of flage F2 is utilized in step 70 for carrying out the program at the next time. In step 83, the fuel cut-off is stopped and fuel is supplied.

Figure 4:
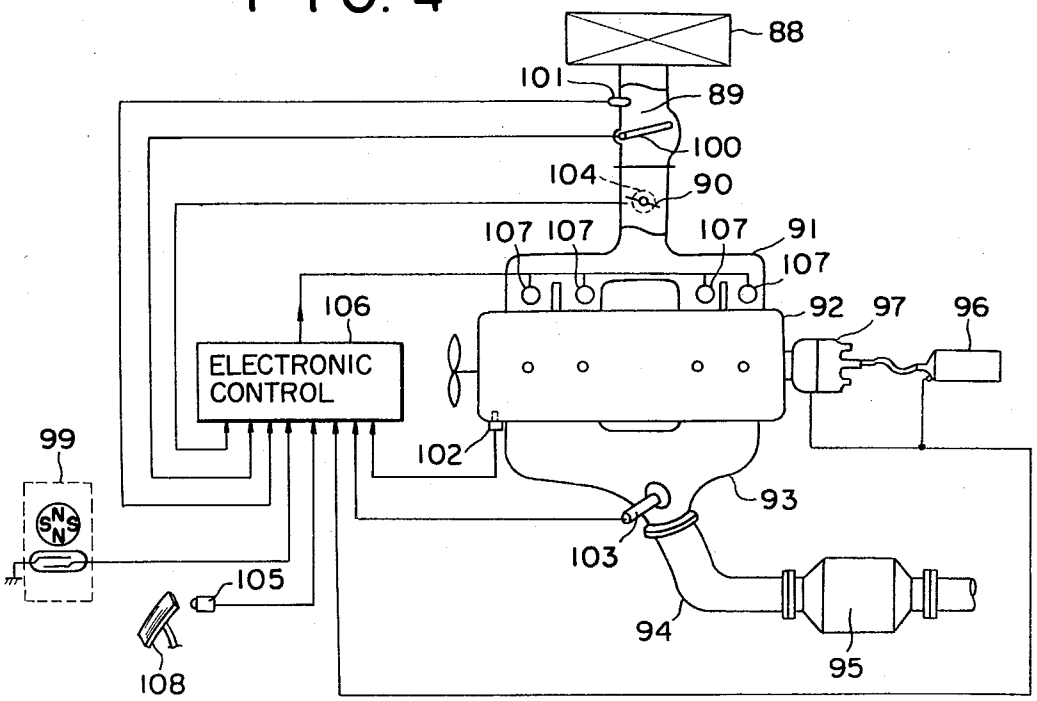
FIG. 4 is a schematic illustration of the whole another electronic control fuel injection engine according to the present invention.

FIG. 4 shows a further embodiment of the electronic control fuel injection engine according to the present invention. Air flow sucked into an intake path 89 through an air cleaner 88 is controlled by a throttle valve 90 interlocked with an accelerator pedal in a cab and conducted the combustion chanber of an engine body 92 through an intake branch pipe 91. An exhaust system is provided with a catalyst converter 95 receiving an exhaust branch pipe 93, exhaust pipe 94 and ternary catalyst sequentially from the upstream side. Current supplied to the ignition plug in the combustion chamber is controlled by an ignition coil 96 and distributor 97. A vehicle speed sensor 99 detects the vehicle speed, an air flow meter 100 detects intake air flow, an intake temperature sensor 101 detects intake temperature, a water temperature sensor 102 mounted on the cylinder block detects cooling water temperature, an air fuel ratio sensor 103 mounted on the exhaust branch pipe 93 detects oxygen concentration in exhaust gas, a throttle sensor 104 detects the opening of the throttle valve 90 and a limit switch 105 detects the operation of a brake pedal 108 in the cab. When the brake pedal 108 is depressed, the limit switch 105 is turned from OFF to ON. Primary current signal of the ignition coil 96, outputs of the air flow meter 100, intake temperature sensor 101, water temperature sensor 102, air fuel ratio sensor 103, throttle sensor 104 and limit switch 105 are sent to an electronic control 106. A fuel injection valve 107 is provided in each branch portion of the intake branch pipe 91 to be opened and closed in response to electric pulses from the electronic control 106.

Figure 5:
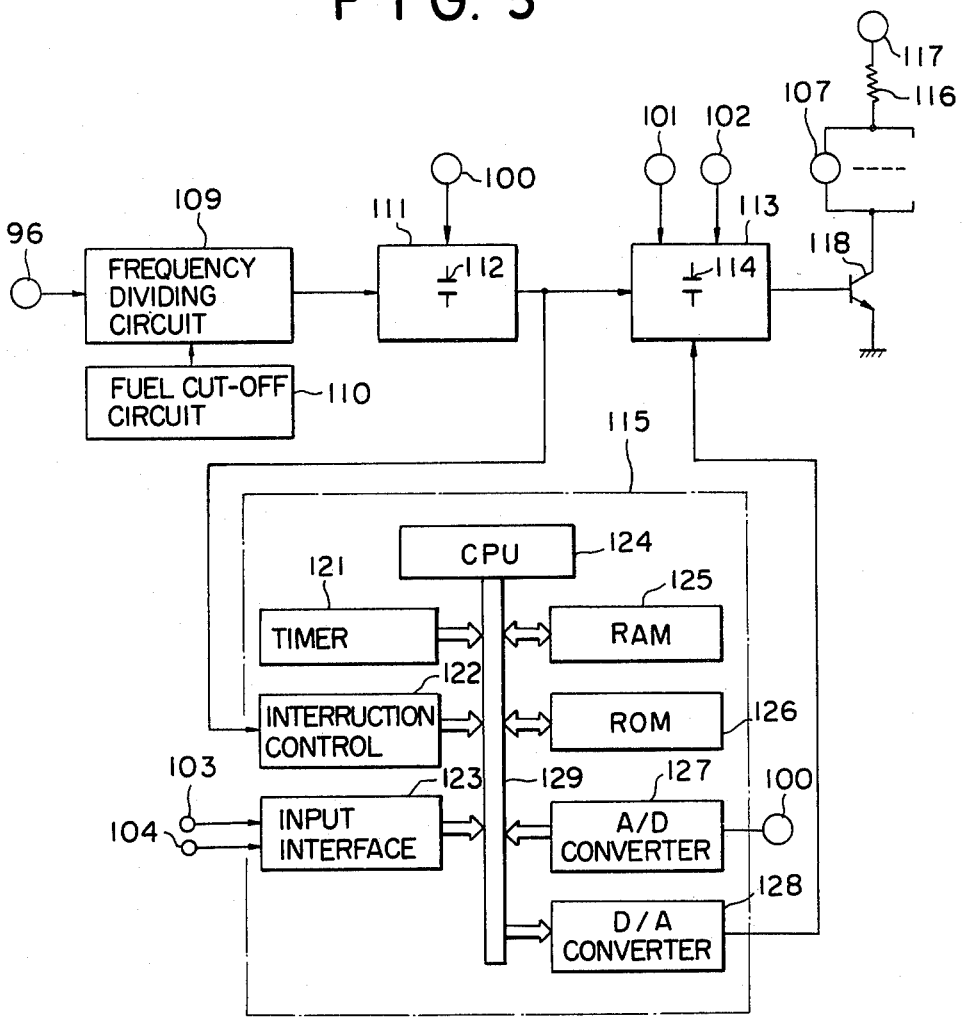
FIG. 5 is a block diagram of the electronic control shown in FIG. 4.
Figure 6:
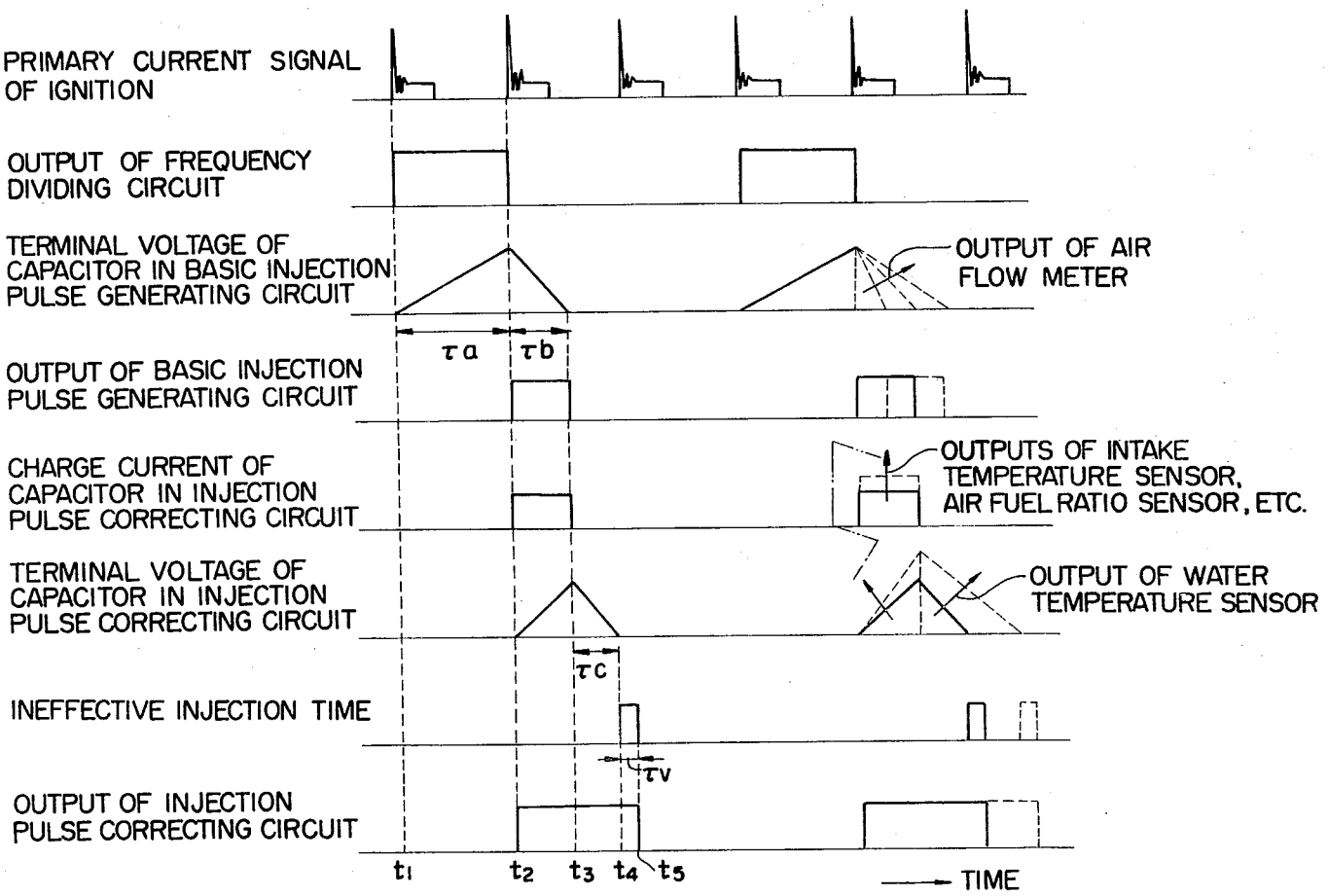
FIG. 6 is a timing chart of the electronic control shown in FIG. 4.

FIG. 5 is a block diagram of the interior of the electronic control 106 and FIG. 6 is a wave-form diagram of voltage in each portion shown in FIG. 5. Primary current signal from the ignition coil 96 is sent to a frequency dividing circuit 109 which produces pulses having same pulse width as that of cycle of the primary current signal from the ignition coil 96. Namely, the output of the frequency dividing circuit 109 from rise time t1 to the next rise time t2 of the primary current signal from the ignition coil 96 is maintained at "1". The output of a fuel cut-off circuit 110 is sent to the frequency dividing circuit 109 and the output of the circuit 109 is maintained at "0" during period of fuel cut-off. A basic injection pulse generating circuit 111 comprises a capacitor 112 which is charged by pulses from the frequency dividing circuit 109 from time t1 to time t2 and discharged from time t2 on by discharge current related to the output voltage of the air flow meter 100. Period of time $\tau a$ from time t1 to time t2 is in inverse proportion to rotational speed N of the engine and terminal voltage of the capacitor 112 in the time t2 is in proportion to 1/N. The terminal voltage of the capacitor 112 becomes zero at time t3 and the output of the basic injection pulse generating circuit 111 is maintained at "1" between time t2 and time t3. The discharge current of the capacitor 112 is reduced as intake air flow Q is increased so that the period of time $\tau b$ from time t2 to time t3 increase as intake air flow Q increases. As a result, $\tau b$ can be proportional to Q/N. The output of the basic injection pulse generating circuit 111 is sent to an injection pulse correcting circuit 113 which comprises a capacitor 114. This capacitor 114 is charged from time t2 to time t3. The charge current to the capacitor 114 varies in relation to the inputs from the intake temperature sensor 101, digital correcting section 115, etc. so that the terminal voltage of a capacitor 115 at time t3 varies in relation to these input signals. The capacitor 114 is discharged from time t3 on by the discharge current related to the input signal from the water temperature sensor 102, and the terminal voltage of the capacitor 114 at time t4 becomes zero. A period of time $\tau c$ from time t3 to time t4 varies in relation to cooling water temperature and, in time t4, pulses with a predetermined pulses width $\tau v$ are generated. The pulse width $\tau v$ is equal to ineffective injection time of the fuel injection valve 107. Pulses with pulse width equal to the period of time from time t2 to time t5 are generated as the output of the injection pulse correcting circuit 113. The fuel injection valve 107 is on one end connected to an accumulator 117 through a resistance 116 and on the other end to an amplifier 118. The amplifier 118, while receiving pulses from the injection pulse correcting circuit 113, conducts electricity so that the fuel injection valve 107 is energized to inject fuel to the intake system at this time. In a digital circuit 115, a timer 121, interruction control 122, input interface 123, CPU(Central Processing Unit) 124, RAM(Random Access Memory) 125, ROM(Read-Only Memory) 126, A/D-(Analog/Digital) converter 127 and D/A(Digital-/Analog) converter 128 are interconnected through a bus 129. The output of the basic injection pulse generating circuit 111 is sent to the interruption control 122, the output pulses of the air fuel ratio sensor 103 and throttle sensor 104 sent to the input interface 123, the analog output of the air flow meter 100 sent to the A/D converter 127. The output of the D/A converter 128 is sent to the injection pulse correcting circuit 113.

Figure 7:
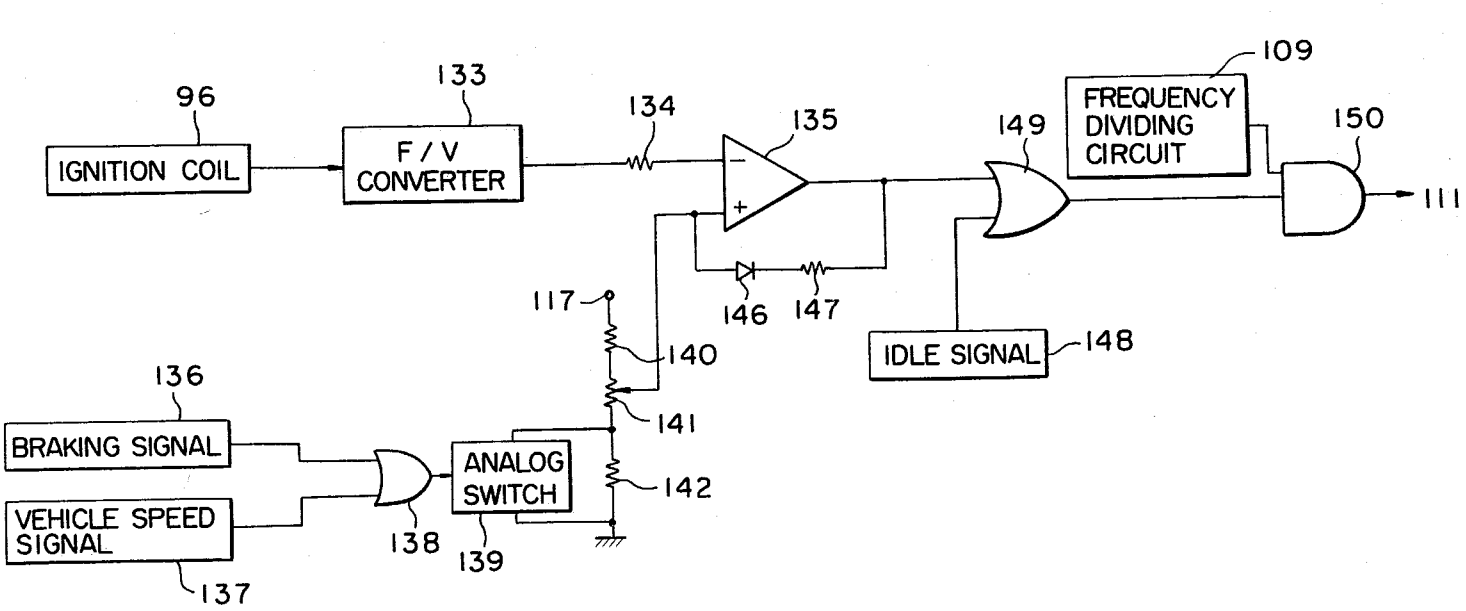
FIG. 7 is a detailed circuit diagram of a fuel cut-off circuit shown in FIG. 5.

FIG. 7 shows details of the fuel cutting-off circuit 110 shown in FIG. 5. The primary current signal from the ignition coil 96 is sent to a F/V(Frequency/Voltage) converter 133, and on the output terminal of the F/V converter 133 is generated voltage proportional to the rotational speed N of the engine. The output of the F/V converter 133 is sent to an inverted input terminal of an operational amplifier 135 through a resistance 134. Braking signal 136 and vehicle speed signal 137 are sent to "or" circuit 138. When the brake pedal 108 is operated to turn on the limit switch 105, the braking signal becomes "1", and when the vehicle speed is larger than predetermined value A, the vehicle speed signal becomes "1". The output of "or" circuit 138 is sent to an analog switch 139. A resistance 140, variable resistance 141 and resistance 142 are interconnected in series between the accumulator 117 and earth. The analog switch 139 is connected in parallel to the resistance 142. The tap terminal of the variable resistance 141 is connected to non-inverted input terminal of the operational amplifier 135, and a diode 146 and resistance 147 are connected between the output terminal and non-inverted input terminal of the operational amplifier 135. The output of the operational amplifier 135 and idle signal 148 are sent to an "or" circuit 149. The idle signal becomes zero when the throttle valve 90 is in the opening of idling. The output of the "or" circuit 149 is sent to an "and" circuit 150. Since the output of the frequency dividing circuit 109 is sent to the basic injection pulse generating circuit 111 through the "and" circuit 150. The signal sent from the frequency dividing circuit 109 to the basic injection pulse generating circuit 111 becomes zero, resulting in the stoppage of fuel injection when the output of the "or" circuit 149 is "0".

When the vehicle speed is larger than predetermined value A or the brake pedal 108 is operated, the output of "or" circuit 138 is "1" and the analog switch 139 is closed. Hence, the non-inverted input terminal of the operational amplifier 135 is set to low voltage V1. Also, when the vehicle speed is smaller than the predetermined value A and the brake pedal 108 is released, the output of the "or" circuit 138 becomes "0" and the analog switch 139 is opened. Thus, the non-inverted input terminal of the operational amplifier 135 is set to high voltage V2(V2>V1). The voltages V1,V2 correspond respectively to the vehicle speeds P1,P2 in steps 78,79 shown in FIG. 3. Thus, when the rotational speed of the engine is larger than the predetermined value P1 or P2 in the deceleration, the output of the operational amplifier 135 is "0", and since the throttle valve 90 is maintained in the opening of idling, the idle signal 148 becomes "0" so that the output of the "or" circuit is maintained at "0" and the pulse of the frequency dividing circuit 109 is prevented from being sent to the basic injection pulse generating circuit 111 so as to cut off fuel.

When the vehicle speed is larger than the predetermined value A or the brake device is operated and the rotational speed of the engine is lower than the predetermined value P1, and also when the vehicle speed is lower than the predetermined value A and the brake device is not operated with the rotational speed of the engine being lower than the predetermined value P2, the output of the operational amplifier 135 becomes "1" and thereby the output of the "or" circuit 149 becomes "1" so that the output pulse of the frequency dividing circuit 109 is sent to the basic fuel injection pulse circuit 111 to stop the fuel cut-off and resume the fuel supply.

What is claimed is:

1. A fuel supply method for an electronic control fuel injection engine in which a fuel injection valve is operated by electric signals to control an amount of fuel supply from the fuel injection valve to an intake system, characterized in that, when a brake device is operated or vehicle speed is higher than a predetermined value, the rotational speed of the engine with the fuel cut-off being completed in the deceleration of the vehicle and the fuel supply being resumed is set to a value smaller than that otherwise set.

2. A fuel supply method as defined in claim 1, wherein whether or not the brake device is operated is detected according to whether or not a brake pedal is operated.

3. A fuel supply method as defined in claim 2, wherein whether or not the brake pedal is operated is detected intermittently and when the brake pedal is continuously operated the rotational speed of the engine in the resumption of fuel supply is set to said smaller value.

4. An apparatus for supplying fuel to an electronic control fuel injection engine in which a fuel injection valve is operated by electric signals to control an amount of fuel supply from the fuel injection valve to an intake system, characterized in that said apparatus comprises a first detecting means for detecting the operation of a brake device, a second detecting means for detecting vehicle speed, a comparator means for comparing the rotational speed of the engine with a reference value to allow the fuel injection valve to be operated when the rotational speed of the engine is lower than the reference value and a control means for receiving detecting signals from the first and second detecting means to set thereby the reference value of the comparator means lower than that set otherwise when the brake device is operated or the vehicle speed is higher than a predetermined value.

5. An apparatus for supplying fuel as defined in claim 4, wherein said comparator means controls the fuel cut-off in such a way that the comparator means permits or blocks the generation of fuel injection pulse sent to the fuel injection valve.

6. An apparatus for supplying fuel as defined in claim 5, characterized in that the first detecting means is a switch for detecting the operational amount of the brake pedal.

* * * * *